US010435892B2

(12) United States Patent
Caboni

(10) Patent No.: US 10,435,892 B2
(45) Date of Patent: Oct. 8, 2019

(54) SPACING ELEMENT FOR MAKING STRUCTURAL, AERATED HEAT-INSULATION CRAWL SPACES

(75) Inventor: Michele Caboni, Oristano (IT)

(73) Assignee: Michele Caboni, Oristano ( * ) Notice: Subject to any disclaimer, the term of this patent is extended or adjusted under 35 U.S.C. 154(b) by 0 days.

(21) Appl. No.: 13/979,569

(22) PCT Filed: Jan. 10, 2012

(86) PCT No.: PCT/IT2012/000006

§ 371 (c)(1),
(2), (4) Date: Jul. 12, 2013

(87) PCT Pub. No.: WO2012/095882

PCT Pub. Date: Jul. 19, 2012

(65) Prior Publication Data

US 2013/0284882 A1 Oct. 31, 2013

(30) Foreign Application Priority Data

Jan. 13, 2011 (IT) ..... TO2011A0014

(51) Int. Cl.

| | |
|---|---|
| ***E04F 15/12*** | (2006.01) |
| ***E04B 5/48*** | (2006.01) |
| *E04B 5/36* | (2006.01) |

(52) U.S. Cl.

CPC ..... *E04F 15/123* (2013.01); *E04B 5/48* (2013.01); *E04B 5/36* (2013.01)

(58) Field of Classification Search

CPC .. E04B 5/48; E04B 5/36; E04F 15/024; E04F 15/12; E04F 15/123

USPC ..... 52/126.2, 220.1, 220.5, 302.1, 302.3; 249/13, 18, 207, 210

See application file for complete search history.

(56) References Cited

U.S. PATENT DOCUMENTS

| | | | |
|---|---|---|---|
| 3,151,391 | A | 10/1964 | Ollier |
| 4,136,798 | A | 1/1979 | Oberstein |
| 4,472,331 | A | 9/1984 | Kida |
| 4,731,968 | A | 3/1988 | Obino |
| 4,833,857 | A | 5/1989 | Wheeler |
| 5,383,319 | A | 1/1995 | Sorqvist |
| 5,428,933 | A | 7/1995 | Philippe |
| 6,370,831 | B1 | 4/2002 | Marshall et al. |
| 7,082,732 | B2 | 8/2006 | Titishov |
| 8,181,414 | B2 | 5/2012 | Garrett |
| 2004/0103609 | A1 | 6/2004 | Wostal et al. |
| 2005/0028466 | A1 | 2/2005 | Titishov |

(Continued)

FOREIGN PATENT DOCUMENTS

| | | |
|---|---|---|
| CA | 2264099 | 2/1998 |
| CH | 367966 | 3/1963 |

(Continued)

OTHER PUBLICATIONS

International Search Report for PCT/IT2012/000006, Completed by the European Patent Office on Jun. 26, 2012, 3 Pages.

*Primary Examiner* — Michael Safavi

(57) ABSTRACT

A structural heat-insulation spacing, element used for making a "disposable" heat-insulation formwork used to cast reinforced concrete into a crawl space, made up of at least one supporting body defining, inside itself, at least one through-hollow co-axial to such supporting body, such through-hollow being suited to minimize a contact surface on the ground provided by such spacing element.

13 Claims, 6 Drawing Sheets

(56) References Cited

U.S. PATENT DOCUMENTS

| | | | |
|---|---|---|---|
| 2007/0214740 | A1 | 9/2007 | O'Grady |
| 2008/0172972 | A1 | 7/2008 | Williams |
| 2009/0044481 | A1 | 2/2009 | Turek |
| 2010/0065716 | A1 | 3/2010 | Amend |

FOREIGN PATENT DOCUMENTS

| | | |
|---|---|---|
| DE | 2013630 | 11/1971 |
| DE | 3410484 | 10/1985 |
| DE | 9418036 | 1/1995 |
| DE | 4332115 | 3/1995 |
| DE | 29611835 | 11/1996 |
| DE | 102008050741 | 4/2010 |
| EP | 0137105 | 4/1985 |
| EP | 0163117 | 12/1985 |
| EP | 0368804 | 5/1990 |
| EP | 0803618 | 10/1997 |
| EP | 1092816 | 4/2001 |
| EP | 1605113 | 12/2005 |
| FR | 663193 | 8/1929 |
| FR | 2328814 | 5/1977 |
| FR | 2813903 | 3/2002 |
| FR | 2874950 | 3/2006 |
| JP | 2002348858 | 12/2002 |
| WO | 9119055 | 12/1991 |
| WO | 03046310 | 6/2003 |
| WO | 2005014948 | 2/2005 |
| WO | 2005035898 | 4/2005 |
| WO | 2005061804 | 7/2005 |
| WO | 2006063140 | 6/2006 |
| WO | 2006081678 | 8/2006 |
| WO | 2008098686 | 8/2008 |

SPACING ELEMENT FOR MAKING STRUCTURAL, AERATED HEAT-INSULATION CRAWL SPACES

CROSS-REFERENCE TO RELATED APPLICATION

This application is the U.S. national phase of PCT Application No. PCT/IT2012/000006 filed on Jan. 10, 2012, which claims priority to Italian Patent Application No. TO2011A000014 filed on Jan. 13, 2011, the disclosures of which are incorporated in their entirety by reference herein.

This invention pertains to a spacing element used for making structural, aerated heat-insulation crawl spaces.

Notedly, the term "crawl space" is conventionally used in the building and construction trade to refer to an air space incorporated into the buildings in order to eliminate, even though in part, the moisture rising up from the soil as well as improve the living environment, though to a limited extent (since the moisture rising up from the soil passes through the foundation beams and the legs in contact with the soil).

In particular, the known methods propose, as regards the making of crawl spaces only of the aerated type, the use of a modular formwork made of recycled plastics, which are laid onto and hooked to one another and act as aerated "disposable" shuttering moulds for obtaining a horizontal surface below which is a ventilated hollow. Such "disposable" shuttering moulds are subsequently completed by plastic panels that make it possible to cast the foundation beams together with the floor, thus making the building of the aerated crawl space quicker, with obvious disadvantages since the moisture rising up from the soil passes through the foundation beams and, indeed, through the structural concrete legs in contact with the soil, thus affecting the whole mass of structural concrete of said surface: in fact, the same conventional disposable formworks do not comply, owing to the above and other reasons, with the specific thermal requirements laid down by the increasingly stricter international standards and regulations.

As an alternative, the known methods propose, as regards the making of an aerated crawl space, the use of columns, that is to say, mere PVC pipes associated with flanges—a method that has been known for a long time in the relevant trade—or domes made of regenerated plastics (another known option), which will, when connected to one another, make up a self-supporting structure, suited to receive the concrete cast, or another material to form a slab of varying thickness, depending on the overload. Examples of such systems are described in EP1605113, EP1092816, EP0803618, U.S. Pat. No. 6,370,831 and WO2008098686.

Both of the aforesaid types of elements used for making a "disposable" formwork are, however, not very safe when considering the workers' foot traffic and, last but not least, offer poor insulation from the soil—such a shortage being liable to improvement.

Therefore, the aim of this invention is to solve the above-mentioned problems relative to the older method, by providing a spacing element used for making aerated, heat-insulation crawl spaces, which will ensure safety when considering the workers' toot traffic and, last but not least, guarantee better insulation from the soil compared to the solutions offered by older methods.

The above and the other aims and advantages of the invention, as detailed in the description hereafter, will be obtained by making use of a spacing element used for making aerated, heat-insulation crawl spaces, such spacing element being described under claim 1. Preferred embodiment designs and original variants of this invention will be the object of the relevant claims.

It is obvious that a number of variants and modifications can be made to the described items (e.g. variants and modifications relative to the thermal resistance, the industrialized manufacturing process, the shapes and dimensions, the type of specular and/or modular hooking, indeed featuring a number of arrangements and parts performing similar functions) without departing from the scope of protection of the invention, as referred to in the enclosed claims.

This invention will be best described by a few preferred embodiments, which will be provided by way of example and with no limitation thereto, with reference to the enclosed drawings, in which.

Figure 1:
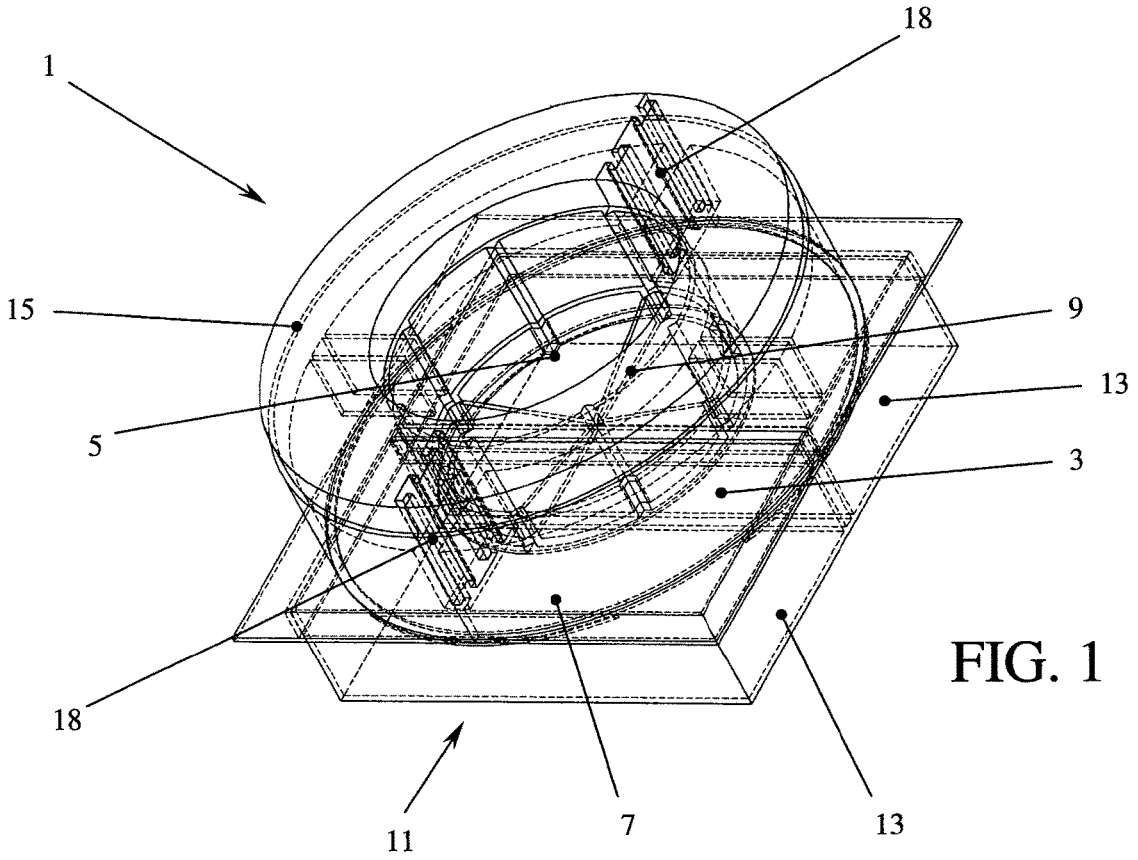
FIG. 1 shows a perspective and partial-section view of a "disposable" shuttering mould and/or formwork intended for an aerated, heat-insulation crawl space including a preferred embodiment of the heat-insulation spacing element in accordance with the present invention.
Figure 2:
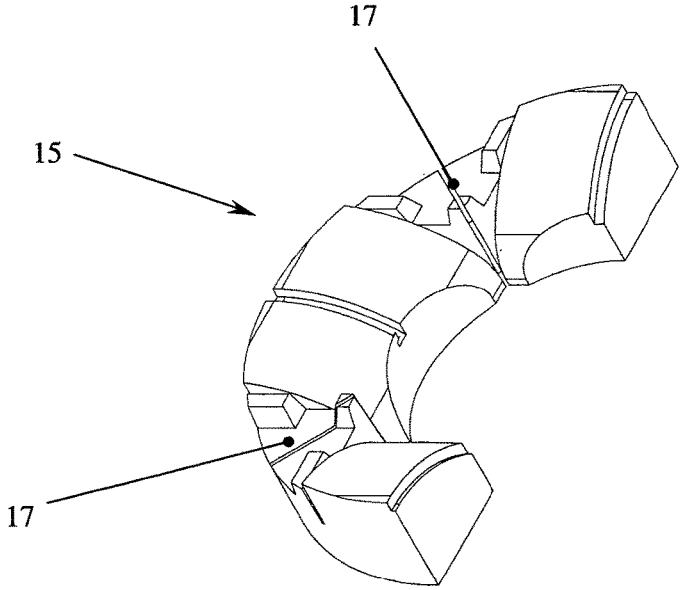
FIG. 2 shows a perspective top view of the transpiring, "disposable" heat-insulation shuttering mould and/or formwork shown in FIG. 1.
Figure 3:
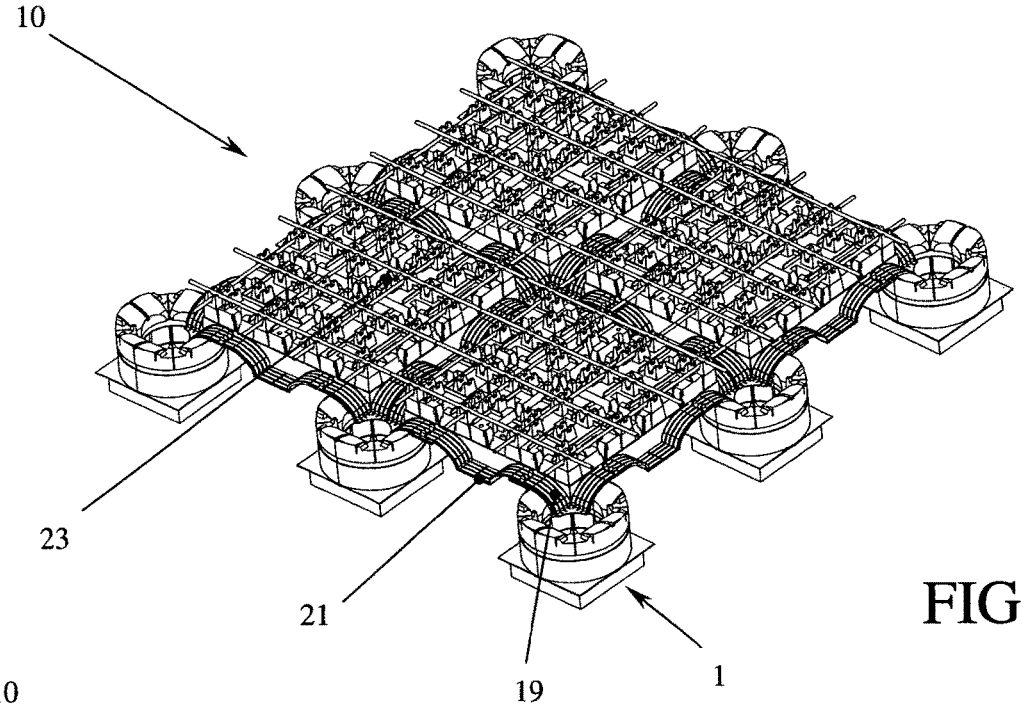
Figure 4:
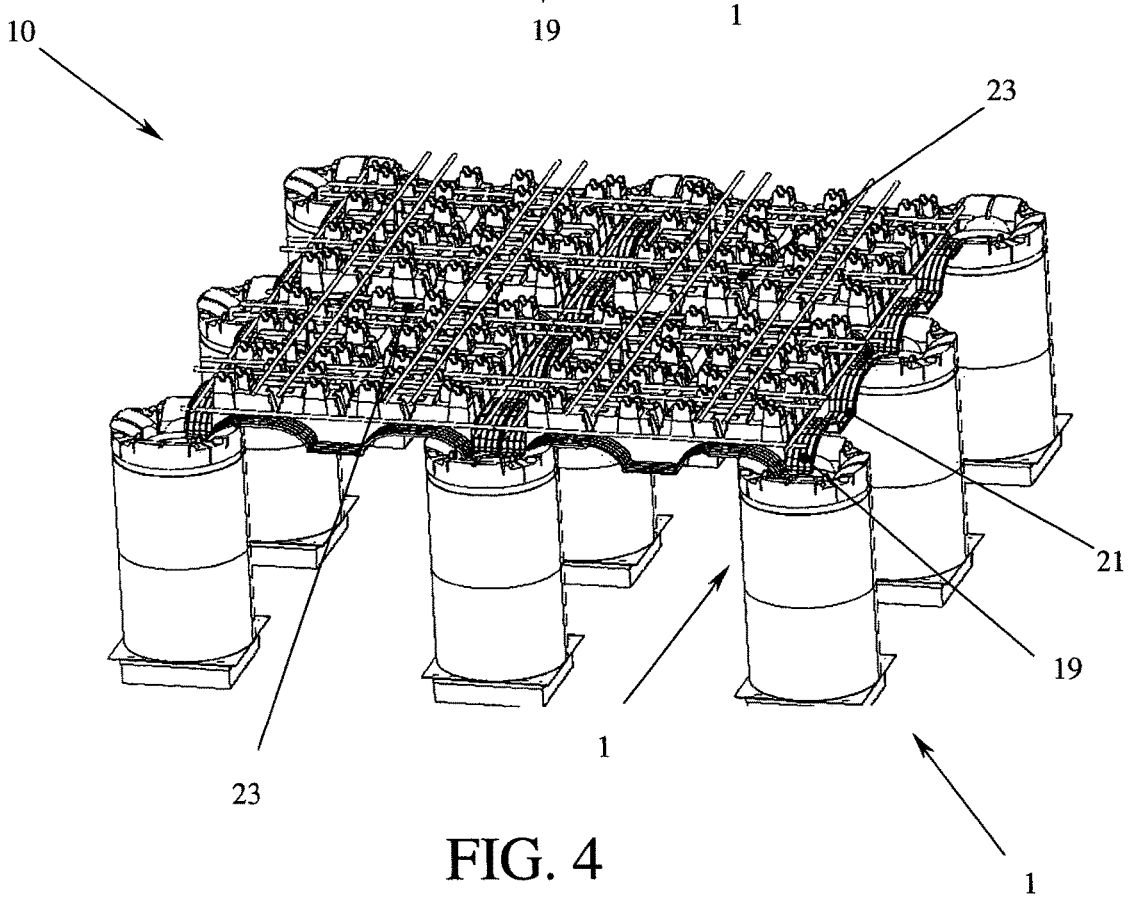

FIG. 3 shows a side view of the transpiring, "disposable" heat-insulation shuttering mould and/or formwork shown in FIGS. 1 and 2; and FIG. 4 shows a perspective top view of a "disposable" shuttering mould and/or formwork intended for an aerated, heat-insulation crawl space including a preferred embodiment of the heat-insulation spacing element in accordance with the present invention, according to an installation variant.

Figure 5:
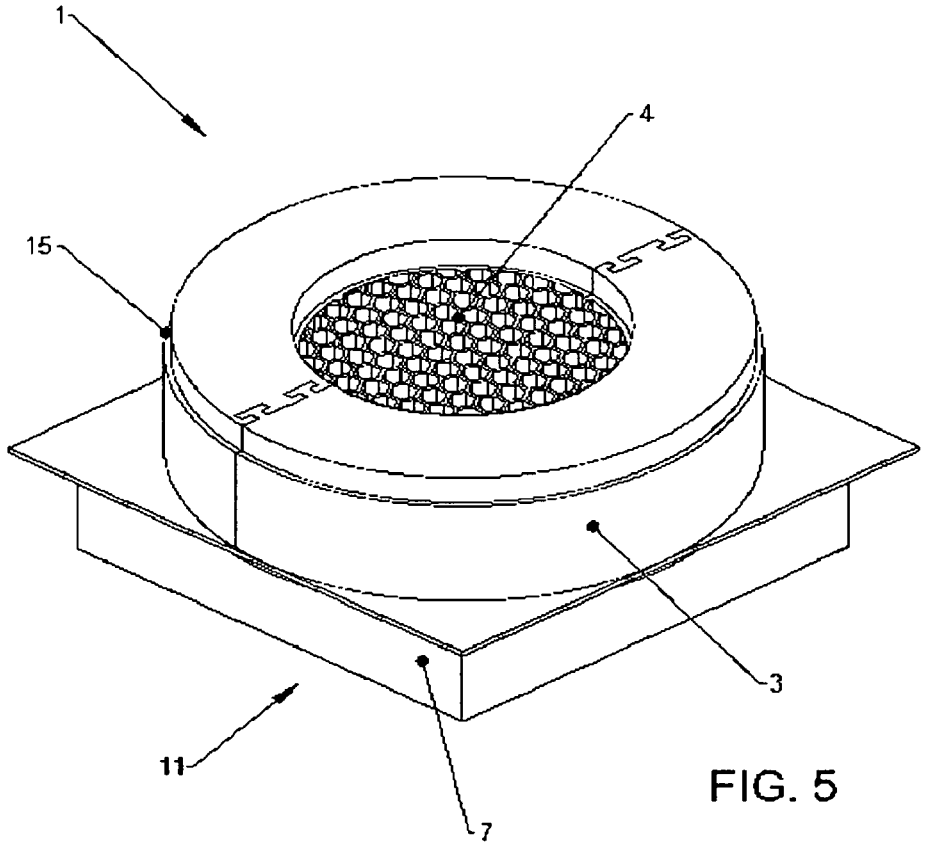

FIG. 5 shows a perspective top view of a "disposable" shuttering mould and/or formwork intended for an aerated, heat-insulation crawl space including a preferred embodiment of the heat-insulation spacing element containing an inner reticular and/or honeycomb core in accordance with the present invention.

Figure 6:
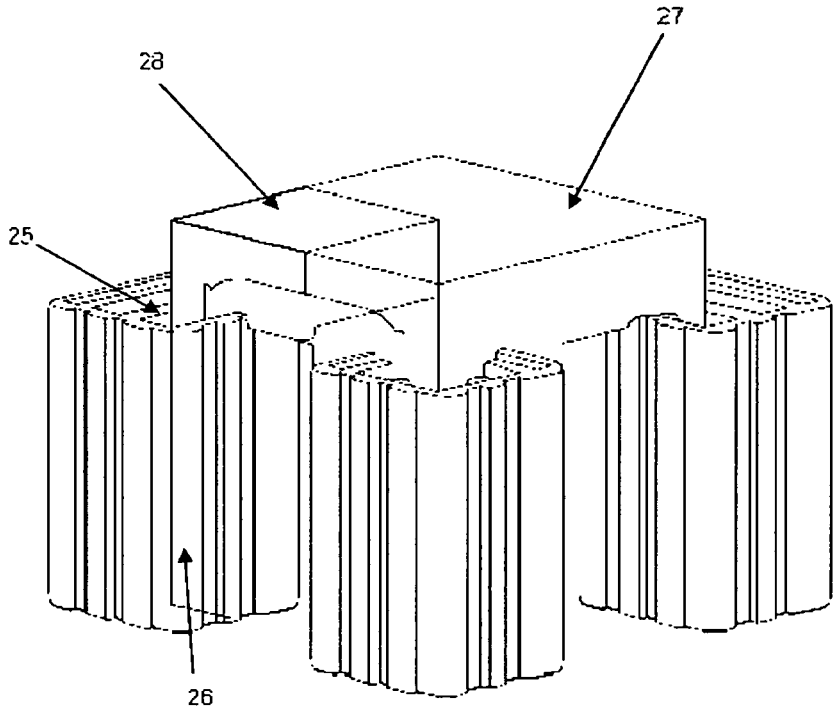

FIG. 6 shows a perspective top view of a "disposable" shuttering mould and/or formwork intended for an aerated, heat-insulation crawl space including a preferred embodiment of the heat-insulation spacing element showing foot supports with plurality of seats for receiving the lower ends of vertical reinforcement irons, leg seat to receive leg of a platform and components of platform linked by male and female dovetail inter-connection.

Figure 7:
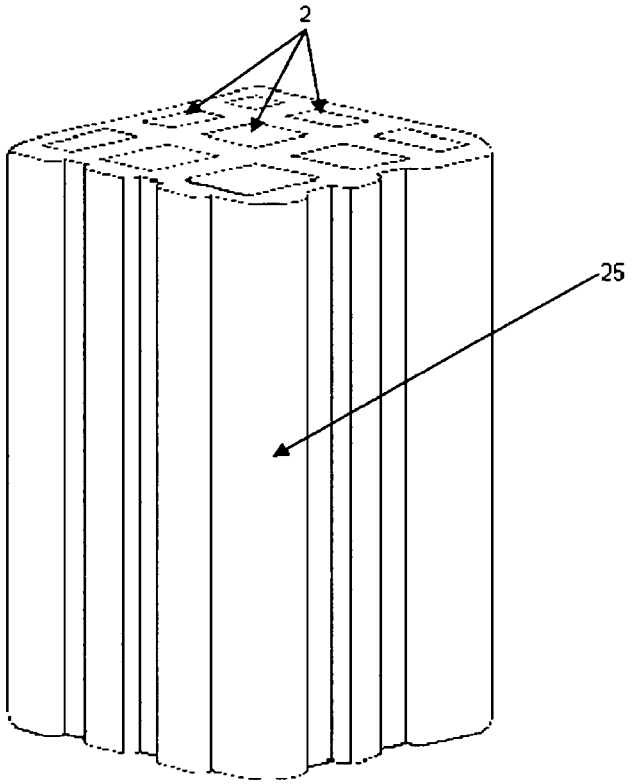

FIG. 7 shows a perspective view showing foot supports with plurality of seats for receiving the lower ends of vertical reinforcement irons and leg seat to receive leg of a platform.

Figure 8:
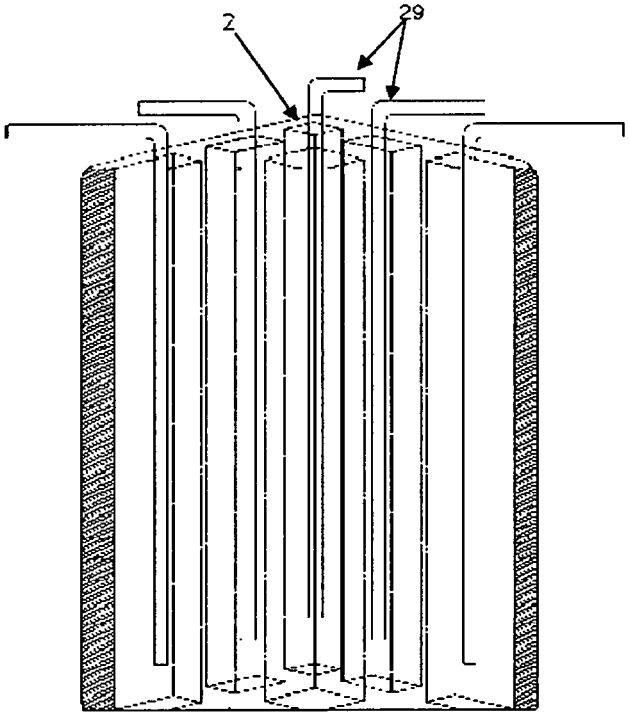

FIG. 8 shows a cross section of view foot support showing plurality of seats for receiving the lower ends of vertical reinforcement irons.

By referring to the Figures, you can notice that the heat-insulation spacing element 1 used for making an aerated, "disposable" heat-insulation shuttering mould and/or formwork 10 used for casting reinforced concrete onto the aerated, heat-insulation crawl space is made up of at least one supporting body 3 defining, inside itself, at least one through-hollow 5 co-axial to such supporting body 3 and suited to minimize the contact surface on the ground provided by the heat-insulation spacing element 1 itself. To this end, the supporting body 3 will preferably feature an essentially cylindrical or toroidal round-plan shape: obviously, the supporting body 3 may take any other shape on the outer plan, such as, for instance, a square, rectangular or rhomboid shape, that is to say, even by modelling depending on the permanent and accidental loads required, that is to say also depending on the seismic stress (if any) said heat-insulation spacers shall withstand, without departing from the scope of protection of this invention.

In a preferred embodiment, the through-hollow 5 is empty: as an alternative, such through-hollow 5 may be filled, at least in part, with at least some insulating material, such as, for instance, polystyrene beads, expanded perlite or polystyrene items adapted to the shape of such hollow 5.

To enhance thermal insulation, that is to say the thermal resistance to the ground, provided by the heat-insulation spacing element 1 referred to in the present invention, the perimeter wall of supporting body 3 may be equipped with at least one base hollow 7.

In order to enhance structural strength under permanent and accidental load and also under any one seismic action by the spacing element 1 referred to in the present invention, reinforcement means may be fitted inside the through-hollow 5, such reinforcement means being, for instance, a plurality of ribs 9, preferably radiated co-axially to the inner hollow 5 itself, suited to join together various points of the inner wall of supporting body 3.

Still in order to enhance thermal insulation from the ground, the heat-insulation spacing element 1 referred to in the present invention may include at least one supporting base 11 equipped with at least one inner hollow 13: such supporting base 11 may be preferably made in the form of a boxed structure defining, inside itself, such hollows 13. Here too, the inner hollows 13 may be empty or, as an alternative, filled (at least in part) with at least some insulating material, such as, for instance, polystyrene beads, expanded perlite or items made of extruded polystyrene and/or polystyrene foam featuring very, high density, adapted to the shape of such hollows 13.

The supporting body 3 of the heat-insulation spacing element 1 referred to in the present invention may also be equipped, at its top, with at least one supporting crown 15 co-axial to the through-hollow 5 and equipped, at its radial portion, with at least one connecting seat 17 suited to make it possible to insert a connecting flange 19 of at least one modular element of a supporting frame 21 suited to support the reinforced concrete casting plane 23 of the "disposable" heat-insulation shuttering mould and/or formwork 10. In particular, as you can notice in the Figures, the supporting crown 15 may be equipped with at least one and/or at least four connecting seats 17 arranged radially at 90° and/or 45° relative to one another, depending on the needs.

In order to facilitate the insertion of the connecting flange 19, the supporting crown 15 may preferably be equipped with a profile flared towards the inside of through-hollow 5.

It is most obvious that the heat-insulation spacing element 1 referred to in the present invention can be made of any one material suitable for the purpose and, in particular, a thermoplastic material filled with talc, or a material made of expanded high-density polystyrene, PVC and/or nylon with fibre reinforcements, such as, for instance, carbon fibre and fibre-glass.

As you can notice in FIG. 2 in particular, the heat-insulation spacing element 1 referred to in the present invention will make it possible to conveniently and advantageously arrange at one's pleasure (for instance, according to a matrix-based arrangement) for the necessary number of such elements 1, so as to support any one shape and size of reinforced concrete casting plane 23 while guaranteeing very high thermal insulation as well as very high insulation from the moisture rising up, due to capillarity, from the soil on which said elements rest.

In addition, the supporting body 3 shall preferably feature constant diameter and width and depth measurements along its entire height, so that, as shown in the example illustrated in FIG. 4, several heat-insulation spacing elements 1 can be overlapped one another to form structural, vertical pillars and/or posts of varying height, which shall be perfectly equal both as regards the lower section and the surface section, indeed the same being adapted in accordance with the specific structural requirements laid down. The inner hollow determined by stacking the through-hollows 5 of the spacing elements 1 stacked shall productively be suited to accommodate the vertical reinforcement irons and the horizontal structural brackets sloping at 45°, indeed complying exclusively with any permanent and accidental load stress and also with the heavy seismic stress: to this end, the supporting base 11 may be equipped with a plurality of seats (not shown) suited to make it possible to insert, inside themselves, the lower ends of the aforesaid irons by keeping the same in the positions required for the final concrete cast, indeed by guaranteeing an adequate bar cover—an essential requirement laid down by standards and regulations worldwide: in addition, each spacing element 1 referred to in the present invention may be equipped, inside its own through-hollow 5, with suitable spacers suited, once again, to keep the reinforcement irons in the several positions required for the additional reinforced concrete cast.

Furthermore, it is most obvious that the heat-insulation spacing element 1 referred to in the present invention can be made by applying any one manufacturing method, such as, for instance, by stamping, by wire-drawing combined (if necessary) with the milling/flaring of the reinforcement hooking parts and the supporting lower and upper seats, and also, last but not least, by hot wire cutting associated with adequate punches suitable for the purpose: in addition, such heat-insulation spacing element 1 might also be made to an inner reticular and/or honeycomb core (not shown) processed by vacuum means, in order only to give top thermal and acoustic features to the element 1.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A heat-insulation spacing element used for making an aerated, "disposable" heat-insulation shuttering mould and/or formwork used to cast reinforced concrete into a crawl space, said heat-insulation spacing element comprising:

at least one supporting body defining, inside itself, at least one through-hollow co-axial to said supporting body, said through-hollow being suited to minimize a contact surface on the ground provided by said spacing element, wherein said supporting body features, at its top, at least one supporting crown co-axial to said through-hollow and is also equipped, at a radial portion of said supporting body, with at least one connecting seat suited to make it possible to insert one connecting flange of at least one modular element of a self-supporting frame suited to support a reinforced concrete casting plane of said aerated, "disposable" heat-insulation shuttering mould and/or formwork, the heat-insulation spacing element comprises at least one portion made of polystyrene, wherein the supporting crown comprises a plurality of connecting seats and the connecting seats are arranged radially at 90 degree and/or 45 degree relative to one another, with the supporting crown defining a profile flared towards the inside of the through-hollow to enable insertion of the connecting flange, wherein said shuttering mould and/or formwork is made directly on the desired site by connecting at least two heat-insulation spacing elements by way of male and female dovetail joints.

2. The heat-insulation spacing element in accordance with claim 1, wherein said supporting body features an essentially cylindrical or toroidal round-plan shape, said supporting body may take any shape on the outer plan including a square, rectangular or rhomboid shape wherein said supporting body is made by assembling at least two supporting body components, which are equipped with male and female dovetail for inter-connection at the desired site.

3. The heat-insulation spacing element in accordance with claim 1, wherein said through-hollow is empty.

4. The heat-insulation spacing element in accordance with claim 1, wherein a perimeter wall of said supporting body is equipped with at least one base hollow.

5. The heat-insulation spacing element in accordance with claim 1, wherein reinforcement means are available inside said through-hollow, which are suited to join together various points of an inner wall of said supporting body.

6. The heat-insulation spacing element in accordance with claim 5, wherein said reinforcement means consist of a plurality of ribs, preferably radiated co-axially to said inner hollow.

7. The heat-insulation spacing element in accordance with claim 1, wherein said heat-insulation spacing element includes at least one supporting base equipped with at least one inner hollow, said supporting base is preferably in the form of a box structure defining inside a hollow is empty.

8. The heat-insulation spacing element in accordance with claim 1, wherein said supporting crown is equipped with a profile flared towards the inside of said through-hollow.

9. The heat-insulation spacing element in accordance with claim 1, wherein said heat-insulation spacing element is machined under vacuum conditions.

10. The heat-insulation spacing element in accordance with claim 1, wherein said heat-insulation element is made by stamping and/or by wire-drawing combined with specific milling of the reinforcement hooking parts and the supporting lower and upper seats.

11. The heat-insulation spacing element in accordance with claim 1, wherein said heat-insulation spacing element is made as a monolith at such a height as needed for the purposed, made of expanded high-density polystyrene by applying a hot wire cutting process associated with specific punches suitable for that purpose, so as to directly obtain specific grooves and seats inside the hollow portion of said heat-insulation spacer.

12. The heat-insulation spacing element in accordance with claim 1, wherein a plurality of heat-insulation spacing elements overlap one another to form structural vertical pillars/or posts of variable heights.

13. The heat-insulation spacing element in accordance with claim 1, wherein the heat-insulation spacing element made of a material suitable for the purpose including a thermoplastic material filled with talc, or a material made of expanded high-density polystyrene, PVC and/or nylon with fibre reinforcements, such as, for instance, carbon fibre and fibre-glass.

* * * * *